United States Patent [19]

Palyi

[11] 3,982,704

[45] Sept. 28, 1976

[54] GRINDING DISK FOR DISK MILLS

[75] Inventor: Leslie Palyi, Don Mills, Canada

[73] Assignee: Palyi-Hansen International APS, Copenhagen, Denmark

[22] Filed: Mar. 21, 1975

[21] Appl. No.: 560,985

[30] Foreign Application Priority Data

Apr. 5, 1974 Germany ..... 2416654

[52] U.S. Cl. ..... 241/298; 241/260

[51] Int. Cl.[2] ..... B02C 7/04; B02C 7/12

[58] Field of Search ..... 241/260, 261.2, 298

[56] References Cited

UNITED STATES PATENTS

| | | | |
|---|---|---|---|
| 2,968,444 | 1/1961 | Jones | 241/260 X |
| 3,170,649 | 2/1965 | Fisher | 241/298 X |
| 3,459,379 | 8/1969 | Brown | 241/298 X |

FOREIGN PATENTS OR APPLICATIONS

| | | | |
|---|---|---|---|
| 690,312 | 4/1940 | Germany | 241/298 |

*Primary Examiner*—Roy Lake
*Assistant Examiner*—Howard N. Goldberg
*Attorney, Agent, or Firm*—Ostrolenk, Faber, Gerb & Soffen

[57] ABSTRACT

Grinding disk for disk mills, including a plurality of annular rings of cutting tools, wherein each ring of cutting tools is formed of a plurality of annularly spaced apart, generally radially oriented saw teeth sets, with the sets of teeth of radially adjacent annular rings being generally annularly offset.

12 Claims, 4 Drawing Figures

GRINDING DISK FOR DISK MILLS

The invention relates to a grinding disk for disk mills. The disk has a radially inner flange and a radially outer mounting flange. Annular webs lie between the flanges, and between the webs cutting tools are fixed. Peripherally or annularly extending toothed grinding blades are held and tensioned in an encircling groove in the outer flange. In known grinding disks of this type the annular chambers between the webs are provided with cutting tools that are in the form of saw blades which are either arranged to extend in the annular or peripheral direction or they are arcuately shaped.

Grinding disks using blade-like grinding tools of this type have compared with the former, usually solid, grinding disks that were made from cast workpieces. The newer disks have the advantage that the grinding tools when worn can be rapidly and simply replaced by new ones without the necessity of regrinding the blunt tools. In addition, with these newer grinding tools, by suitable choice of the tooth size and tooth form, the grinding operation may be influenced in desirable manner and adapted to the particular material being ground. However, with the known grinding disks which use saw blades there was a difficulty common with the former solid grinding disks as regards the heat which is inevitably generated. The heat limits the relative speeds of rotation between the grinding disks and thus also the grinding power.

The invention is directed to retaining the favourable grinding action and the easy replaceability of the grinding tools and to constructing the grinding disk in such a manner that heat generation is reduced and optimum dissipation of the heat that has been generated is guaranteed.

According to the invention this problem is solved with a grinding disk of the type mentioned at the beginning in that the tools are formed by tooth rows which are secured to extend substantially radially and in mutually spaced relationship in the annular chambers formed by ring shaped webs and flanges, and that the tooth rows of adjacent annular chambers are offset with respect to each other. For certain specific purposes it may be convenient to permit two such grinding disks to cooperate. For conventional grinding operations, however, it is preferable to use as counter disk a grinding disk which is provided with relatively closely adjacent grinding tools, for example, a grinding disk of the aforementioned conventional type or a grinding disk according to German patent specification 1,809,251. A grinding disk constructed according to the invention is more particularly a rotating grinding disk which cooperates with a stationary disk having a dense grinding tool arrangement. With a vertical arrangement of disk axes, the grinding disk according to the invention forms the upper disk. It is however also possible to arrange the mill which includes the grinding disk according to the invention with the axis horizontal.

Due to the spaced arrangement of the tooth segments in the annular chambers air spaces are formed which reduce the generation of heat and carry away the heat produced in that these two segments result in a fan effect by which the heat is dissipated. A particularly favourable effect is achieved if the tooth rows have a mutual spacing which is substantially equal to their radial length and if the tooth rows are also inclined at a small angle with respect to the radius. Conveniently, the angle of the tooth rows in consecutive annular chambers are different so that an irregular honeycomb-like structure is formed.

To simplify the replacing of the grinding tools the latter are constructed according to a further development of the invention as U-shaped angle pieces which carry teeth at the ends of their two legs and are secured with their centre webs to the disk bottom by mounting screws.

According to a further development of the invention the legs of the U-shaped angle piece are provided with holes, which enables the cooling air action to be improved. Particularly favourable results may be achieved by providing only one leg with a perforation.

Summarizing, the grinding disk according to the invention has the following advantages compared with conventional grinding disks:

The heat generation during the fractionating between the rotating grinding disk and the stationary grinding disk is drastically reduced. This improves the quality of the ground material, which is very sensitive to heat and heat storage. With products having a high fat content and high moisture content this generation of heat has a damaging effect.

A further important advantage is seen in the reduction of the necessary drive power. In addition, the disk according to the invention permits a substantial individual adaptation to the particular material to be ground. Firstly, the openings in the U-shaped tools may be adjusted in any desired manner. In addition, the spacing between tools on the disk may be varied as may the speed of rotation of the grinding disk. This adjustment of the speed of rotation of the disk is however only advisable for cases in which a grinding disk is to be used for various types of ground products and different degrees of fineness. For example, pulverization, a microgrinding operation, a grinding with conventional size and a coarse grinding may be carried out with one and the same disk.

The large range of variation which may be achieved is due to the fact that a considerable amount of air and a considerable air velocity is generated because of the rotary motion. The pressure progressively rising from the centre towards the peripheral face and terminating with a so-called stabilization. The grinding setting may however easily be determined from the starting product.

The air volume is comparable with the product volume and the speed of the disk. In this manner the air in each individual chamber, i.e. in each cell of the honeycomb structure, is subjected to an adequate pressure for pressing the product tightly against the opposite grinding disk.

The suspension of the product in the air is determined by two basic factors, i.e. the centrifugal force through the fan action and the air pressure produced by the continuous rotation, and as a result the product is set simultaneously into two circular movements. The first such movement is the rotation from the centre towards the peripheral face and the other such movement is a rotation within the individual honeycomb cells or chambers. These movements prevent the formation of different product sizes and fraction formations between the solid constituents. The constant air volume and the pressure produces a well balanced reduction.

It is possible to vary the size of the honeycomb cells and make them larger or smaller depending on the product to be ground and the requirements made of said ground material.

The stationary disk comprises a grinding surface in the form of saw blades which may be easily replaced.

The number of grinding stages, which are determined by the individual annular chambers, depends on the size of the machine and the diameter of the disks. It is of course also possible to use an ordinary steel plate as stationary disk but this has the disadvantage mentioned at the beginning as regards wear.

The peripheral speed of the disk may for example be varied between 30 m/s and 200 m/s.

It is also possible to employ the honeycomb structure of the grinding disk alternatively horizontally or vertically. Furthermore, the two cooperating disks may rotate in opposite directions.

A further advantage of the honeycomb structure is that an easy interchanging and replacement of the grinding tools is possible.

The material to be ground is supplied via a central opening in the stationary disk via a distributing disk which distributes the product uniformly over the grinding surface. The surface of the stationary disk is preferable made conical.

The disk having the honeycomb structure comprises two or more annular passages, depending on the size of the mill. The depth of the passages is great enough for adequate air to be present for the treatment and generation of pressure.

The saw tooth blades rotating at the outer edge are of decisive importance as regards the uniformity of the product before the latter leaves the grinding disks.

The adjustment of the speed may be made as mentioned in accordance with the requirements of the particular individual case. The higher the speed the finer the ground material, i.e. for a microgrinding operation a higher speed of rotation is used than for a standard grinding operation.

An example of embodiment of the invention will be described hereinafter with the aid of the drawings, wherein.

Figure 1:
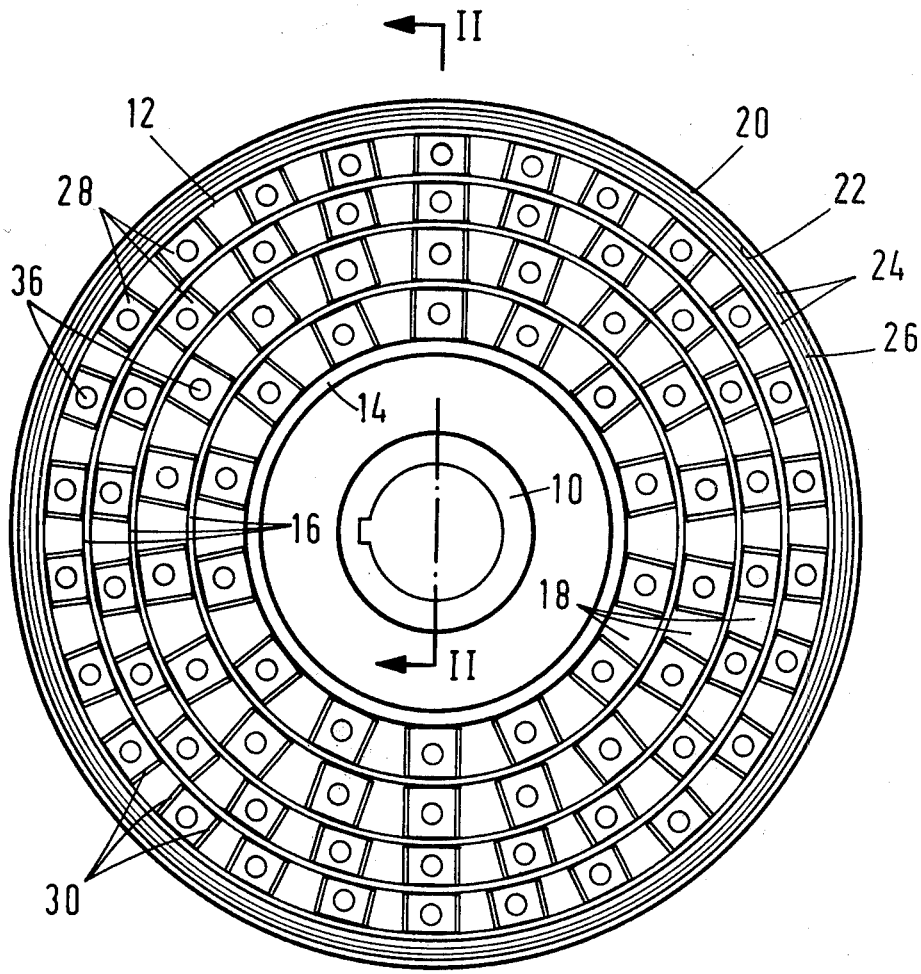
FIG. 1 is a view of a grinding disk constructed according to the invention.
Figure 2:
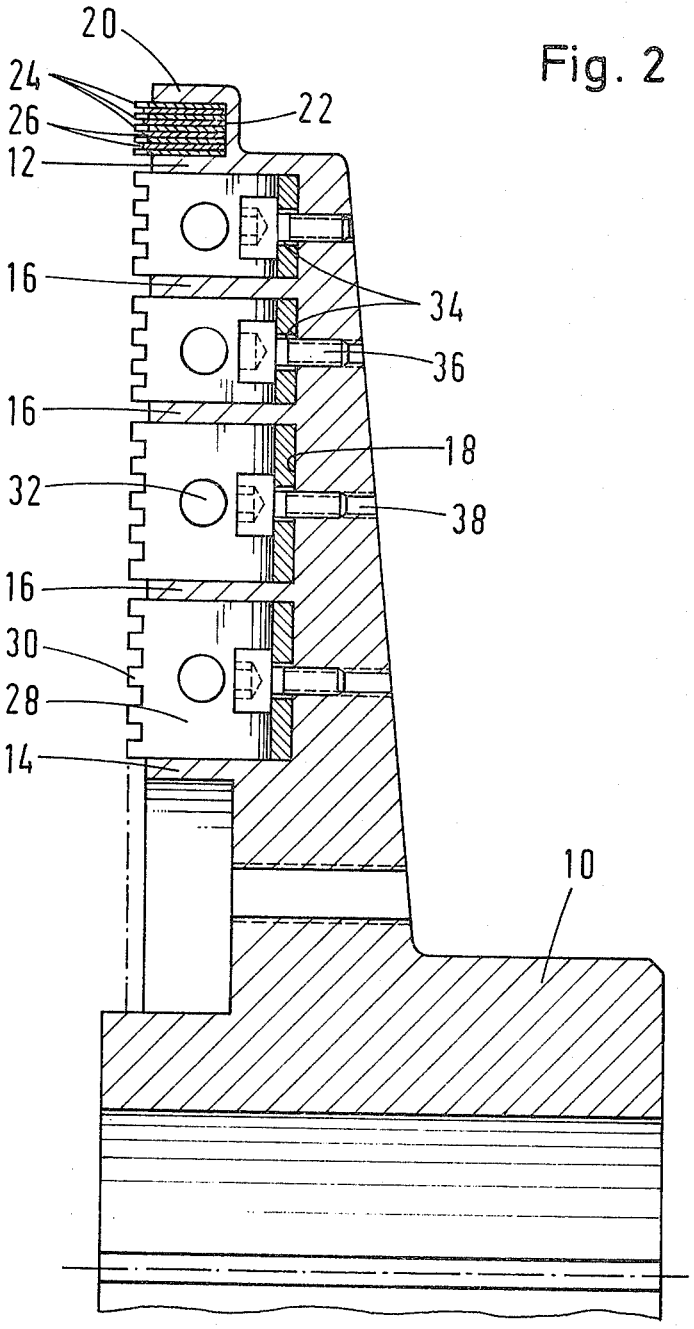
FIG. 2 is a section along the line II—II of FIG. 1.

The grinding disk comprises a hub 10 with which it is mounted on a drive shaft. Disposed between a radially outer annular flange 12 and a radially inner annular flange 14 is a plurality of webs 16 which extend in the peripheral direction and by which the disk is divided into a plurality of concentric annular chambers 18 of different radial dimensions. In FIG. 1, it is seen that the radial dimensions of chambers 18 gradually decreases radially outwardly of hub 10.

Figure 3:
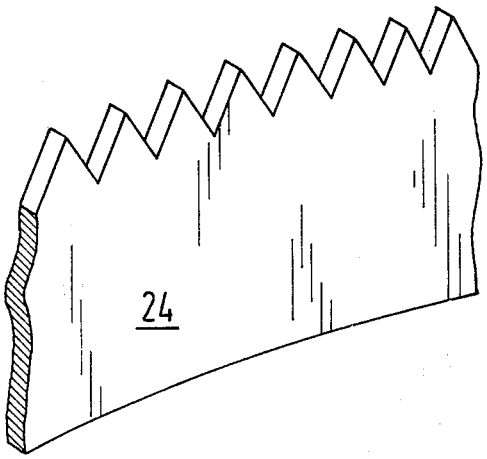
FIG. 3 is a perspective view of a portion of a saw blade rotating at the outer edge of the grinding disk.

An L-shaped annular web 20 projects from the outer flange 12 and forms an annular groove 22 in which the saw blades 24 extending in the peripheral direction are inserted alternately with spacer blades 26. A portion of a saw blade 24 is illustrated in FIG. 3.

Figure 4:
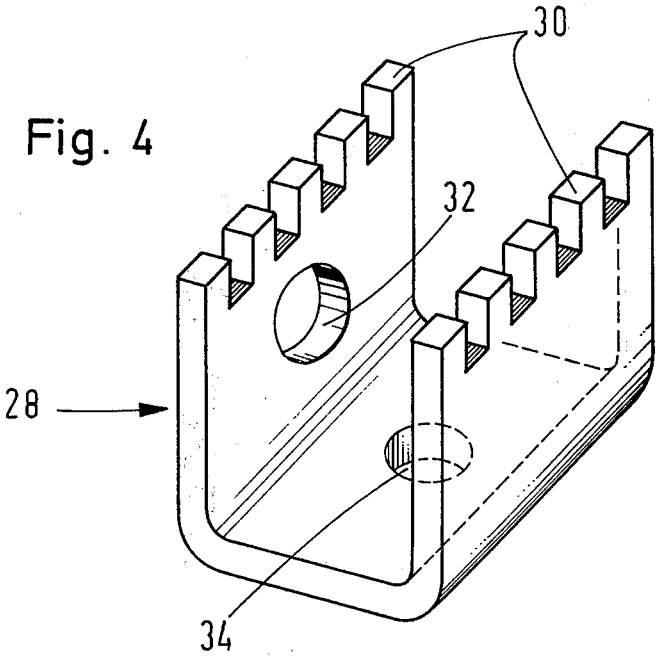
FIG. 4 is a perspective illustration of an individual grinding tool.

Tools in the form of U-shaped angled sheet metal members 28 are inserted in the annular chambers 18 and their construction is apparent from FIG. 4. These U-shaped members are provided at the free end of their legs with tooth rows 30 in the form of rectangular teeth. One of the legs is provided with an air hole 32. The centre connecting portion comprises a hole 34 through which a mounting screw 36 can be inserted which may be screwed into a threaded bore 38 in the bottom of the disk.

As apparent from FIG. 1, the tools 28, the size and number of which are chosen in dependence upon the particular requirements, are inserted into the annular chambers 18 in such a manner that the tooth rows 30 extend in the radial direction or preferably at a slight angle to the radius. The two tooth rows 30 of an angled member 28 may extend with parallel flanks but alternatively may also be set at an angle to each other.

The invention is also to cover the case in which the U-shaped tools are screwed with their centre leg to the annular webs 16 or the flanges 12 or 14, and in the latter case the tooth rows 30 are not arranged at the ends of the legs but laterally thereon. This would make it possible to fix two angle members of adjacent annular chambers by means of one mounting screw. Nevertheless this type of mounting is more complicated than the mounting by screws parallel to the axis because in this case a tool may be fitted directly and continuously rotated.

We claim:

1. A grinding disk for a disk mill, said disk comprising:

a radially inner mounting flange;

a radially outer mounting flange spaced radially outwardly from said inner flange; toothed grinding blade means carried in said outer flange and having teeth facing out of a surface of said disk;

at least one web positioned between and spaced from said inner and said outer flanges, thereby defining a plurality of chambers comprising a radaially inner chamber between said inner flange and a said web and a radially outer chamber between said outer flange and a said web;

a plurality of cutting tools arranged in mutually spaced relationship around and affixed to said disk in each said chamber; each said tool comprising a row of teeth and all said teeth face out of said surface of said disk; each said tool row of teeth extending generally radially of said disk; each said row of teeth in one said chamber being near, in an annular direction around said disk, at least one said row of teeth in the annular adjacent said chamber, at least some of said rows of teeth in each said chamber being annularly offset from the said near row of teeth in the radially adjacent said chamber.

2. A grinding disk according to claim 1, wherein each said row of teeth has a direction of extension that is transverse to a respective radius of said disk.

3. Grinding disk according to claim 2, wherein adjacent said rows of teeth in a said chamber are oriented in respective said directions of extension that are transverse to each other.

4. Grinding disk according to claim 1, wherein each said row of teeth has a respective length that is substantially the radial width of its said chamber; each said row of teeth being spaced from the adjacent said row of teeth in its said chamber a distance approxiating said length of that said row of teeth.

5. Grinding disk according to claim 1, wherein said chambers are concentric and their respective radial widths differ.

6. Grinding disk according to claim 5, wherein moving radially outward on said disk, each said chamber has a smaller radial width than the next radially inward said chamber.

7. Grinding disk according to claim 1, further comprising a plurality of generally U-shaped support members in each said chamber; each said support member comprising two legs joined by a connecting web; each said support member leg having a free end on which a said row of teeth is defined; securement means securing each said web into position on said disk.

8. A grinding disk according to claim 7, wherein said rows of teeth are each set at an angle to a radius of said disk; adjacent said rows of teeth in a said chamber being oriented at an angle to each other.

9. A grinding disk according to claim 7, wherein moving radially outward of said disk, each said chamber has a smaller radius width than the next radially inward said chamber.

10. A grinding disk according to claim 7, wherein one of said leg of each said support member has a hole therethrough for permitting through flow of air.

11. A grinding disk according to claim 1, further comprising a respective support for joining each said row of teeth to said disk; at least some of said teeth row supports having holes therethrough for permitting through flow of air.

12. Grinding disk according to claim 1, wherein each said row of teeth is comprised of a plurality of teeth and each said tooth of a said row being generally rectangular in profile; adjacent said teeth in a row thereof being separated by a generally rectangularly shaped gap.

* * * * *